United States Patent [19]

Sanderson

[11] Patent Number: 4,646,944

[45] Date of Patent: Mar. 3, 1987

[54] LIQUID DISPENSING APPARATUS

[76] Inventor: Walter Sanderson, 3550 Atlanta Industrial Pkwy., Atlanta, Ga. 30331

[21] Appl. No.: 766,794

[22] Filed: Aug. 19, 1985

[51] Int. Cl.[4] ..... B67D 1/16

[52] U.S. Cl. ..... 222/108; 222/185

[58] Field of Search ..... 222/181, 185, 108, 173, 222/325; 248/146, 154, 311.3, 312.1, 313

[56] References Cited

U.S. PATENT DOCUMENTS

| | | | |
|---|---|---|---|
| 249,993 | 11/1981 | Rehfuss | 222/181 |
| 683,768 | 10/1901 | Innes | 222/185 |
| 948,883 | 2/1910 | Hughes | 222/185 |
| 1,319,376 | 10/1919 | Cooper | 222/185 |
| 2,602,571 | 7/1952 | Shebordy | 222/327 |
| 4,386,718 | 6/1983 | Stewart et al. | 222/185 |

*Primary Examiner*—H. Grant Skaggs

*Attorney, Agent, or Firm*—McDougall, Hersh & Scott

[57] ABSTRACT

A liquid dispensing apparatus is provided for use in combination with rigid or semi-rigid inverted liquid containers. The liquid dispensing apparatus is comprised of a base portion that provides a stable platform for the combination, a coupling extending up from the base portion that is inserted into the neck of the open liquid container to provide a seal around the neck and to provide an opening to discharge the liquid, and a spigot with a valve in communication with the opening to control the flow of liquid. A stabilizing arm extending from the base portion contacts the bottom of the liquid container and, in conjunction with the coupling, secures the liquid container to the liquid dispensing apparatus. The base portion is also designed to contain any liquid that may leak from the coupling.

5 Claims, 3 Drawing Figures

LIQUID DISPENSING APPARATUS

BACKGROUND OF THE THE INVENTION

The present invention relates generally to a dispensing apparatus used to control the flow of liquids from rigid or semi-rigid containers. More specifically, it relates to a liquid dispensing apparatus useful in conjunction with plastic containers in which milk, juices and other beverages which should be kept cool, are sold.

For reasons of both convenience and economy, the purchase of beverages in such containers has become popular. However, there are several disadvantages to the use of such containers, particularly in the popular one gallon size. Even with a self-contained handle, because of the size and shape of the container and the rate at which liquid flows from it, it can be difficult to pour out the exact amount of the liquid desired into a drinking glass or other smaller container. This difficulty is magnified when the container is first opened and heavy with the liquid stored therein. Then, there is also a greater chance that the user will pour too much liquid into the smaller container, spilling the liquid and wasting the portion spilled.

In addition, these containers usually contain beverages which need to be kept cool, making it necesary to take the container in and out of a refrigerator whenever the beverage is desired. Small children, the elderly, and others with insufficient motor skills, may find having to do this, plus having to take off or unscrew any lid on the container and having to turn it over to pour from it, so difficult they are unable to use the container.

Liquid dispensing apparatus for use in combination with liquid containers are well known in the art. Often they have a base portion with an upward extending boss in the center and an interior bore extending from the bottom of the boss to a valve mechanism. The neck of the liquid container is coupled into the boss and the combination is inverted for use. Alternatively, they will have a large semi-spherical cavity in the base portion to accommodate the upper section of the inverted liquid container.

In some liquid dispensing apparatuses known to the applicant, the dispensing apparatus and liquid container are mounted together by a coupling piece on the dispensing apparatus. To insure a secure fit, the coupling piece must have a locking flange, threaded walls, or an O-ring, that meshes with complementary means on the liquid container. This means the dispensing apparatus may only be used with liquid containers that have the necessary coupling attachments. In addition, the cost of machining the dispensing apparatus with the coupling means is relatively high.

Another disadvantage to the current dispensing apparatus is the means used for stabilizing the inverted liquid container when it is mounted on the apparatus. Where the liquid container is of rigid material such as glass, some systems rely on a secure coupling means in the base portion for keeping the container stable. For semi-rigid plastic containers, this is plainly unsuitable. In addition, such a system provides minimal stable support should the liquid container be accidentally bumped or moved as would happen if it were in use in a refrigerator. Other dispensing apparatus have a vertical member extending up from the base portion, with one or more horizontal members extending from it, the horizontal members securing the liquid containers. In other dispensing apparatus the large base portion that encompasses the upper section of the liquid container serves to stablilize the combination. These dispensing apparatus are unattractive and relatively exensive to produce.

Hence, it is an object of this invention to provide a dispensing apparatus with a coupling means that does not need to be used in conjunction with a complementary attachment on the liquid container.

An additional object of this invention is to provide a dispensing apparatus with a coupling means that does not have to be made with a special securing means.

An additional object of this invention is to provide a dispensing apparatus of such design that it can be used conveniently in an area with minimal space, such as a refrigerator.

It is a further object of this invention to provide a liquid dispensing mechanism with a liquid container support mechanism that is simple to manufacture and pleasing to the eye.

An additional object of this invention is to provide a liquid dispensing apparatus that will contain any leaks from the coupling and the liquid container it is used with, making the clean-up of such leaks a simple task.

BRIEF DESCRIPTION OF THE INVENTION

The foregoing and other objects of the invention are achieved by providing a base portion having an upwardly extending nozzle so that the neck of the inverted liquid container can be inserted over the nozzle, with the nozzle in communication with a spigot. The inverted liquid container is secured to the base by means of the nozzle and with a stabilizing arm that extends from the base portion to the bottom portion of the container.

BRIEF DESCRIPTION OF THE DRAWINGS

The invention itself is described in the detailed description taken in conjunction with the drawings in which.

DETAILED DESCRIPTION

Figure 2:
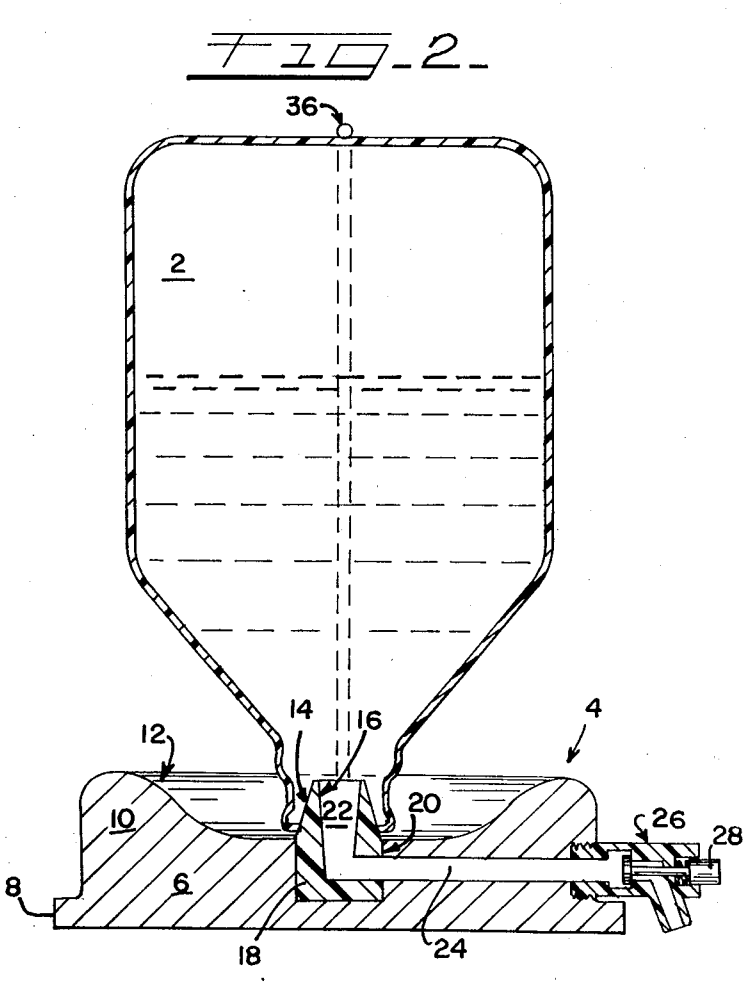
FIG. 2 is a cross-sectional view taken along the line 2—2 in FIG. 1; and, FIG. 3 is a cross-sectional view of an alternate embodiment of the base portion of the invention.
Figure 1:
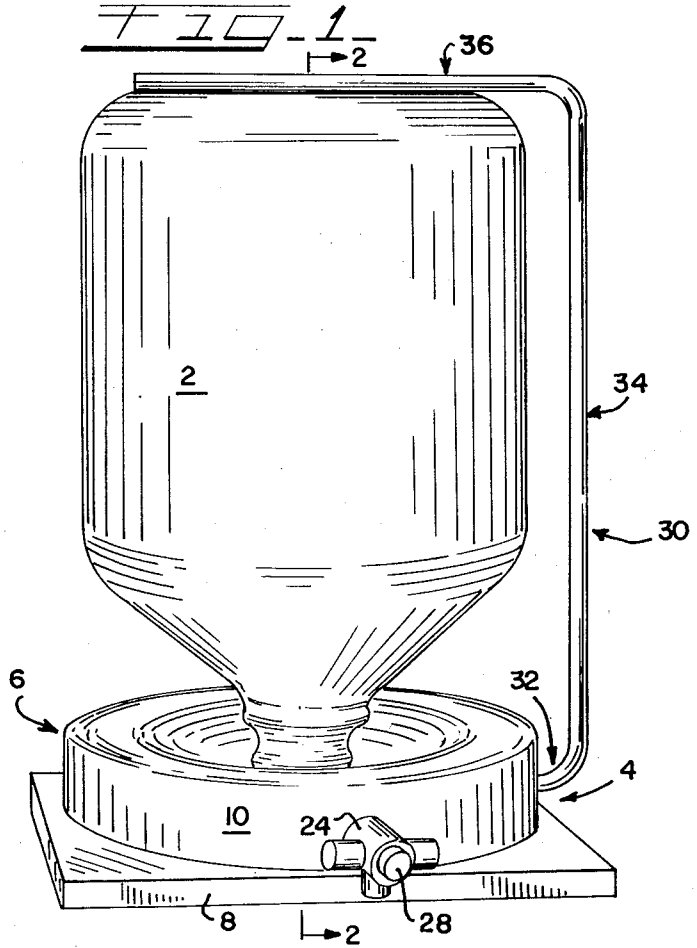
FIG. 1 is a side view of the preferred embodiment of the invention.

FIGS. 1 and 2 illustrate the liquid dispensing apparatus 4 in use in combination with inverted liquid container 2. The liquid dispensing apparatus 4 has a base portion 6 preferably formed of plastic, and subtending an area slightly greater than that of the liquid container 2. In this embodiment, the base portion 6 is comprised of a lower base portion 8 of generally square shape, and an upper base portion 10 of generally circular shape which is centered on the lower base portion. The upper base surface 12 of upper base portion 10 is a circular concave surface concentric with the upper base portion.

Figure 3:
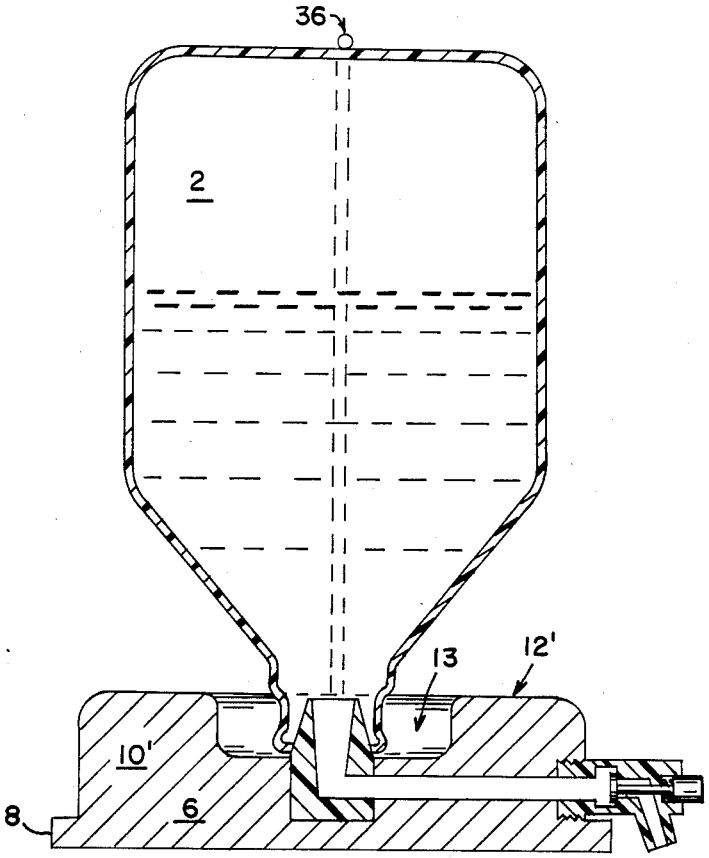

FIG. 3 illustrates an alternative embodiment for the upper base portion 10'. The upper base surface 12', is planar, and large bore 13 is located in the center of the upper base portion 10'.

Located in the center of upper base portion 10 is nozzle 14 composed of hardened rubber, or other suitable material that is slightly flexible. The nozzle 14 is composed of nozzle top portion 16 that is of a generally conic shape and extends above the upper base surface 12, and a nozzle lower portion 18 that is of generally cylindrical shape and that is friction-mounnted into a bore 20 of upper base portion 10. A cavity 22 having a generally-tapered shape extends from the top of the nozzle top portion to an intermediate location in the nozzle lower portion.

Extending perpendicularly from the bottom of cavity 22 is longitudinal bore 24 which pases through the nozzle lower portion 18 and upper base portion 10 to the side of the upper base portion. The outer end of the longitudinal bore 24 is enlarged and threaded to accommodate spigot 26 which is provided with plunger-type valve 28.

Extending upwards from the side of the upper base portion 10 and perpendicular to the longitudinal bore 24 is stabilizing arm 30 formed of a lightweight resilient material that resists deformation, and has a generally circular cross-section. The stabilizing arm 30 comprises coupling section 32 which is pivotally mounted in the side of upper base portion 10. The arm has vertical section 34 extending upwardly from the coupling section with a height substantially equal to the inverted liquid container 2, and it also has horizontal stabilizing section 36 extending perpendicularly from the vertical section diametrically across the bottom of the inverted liquid container.

Alternative constructions of the stabilizing arm 30 are possible. The coupling section 32 may be friction mounted or threaded to the upper base portion and the stabilizing section 36 may be designed to have spring-like flexibility so liquid containers can be inserted and removed under it. The vertical section may have a telescoping or folding means to adjust for liquid containers of different height and to make the insertion and removal of liquid containers easier. The horizontal stabilizing section may be an L-shaped or diamond-shaped member, and may extend from the vertical section at an angle so that it is in contact with a selected portion of the bottom of the liquid container. Alternatively, the horizontal stabilizing section may have a flattened bottom portion having a large surface area in contact with the bottom of the liquid container.

To use, the liquid dispensing apparatus 4 is first inverted and placed over the liquid container 2 with nozzle 14 inserted into the open neck of the liquid container. The stabilizing arm 30 is then rotated around coupling section 32 so the horizontal section 36 is in contact with the bottom portion of the liquid container and exerts some pressure on it. A slight downward force is then applied to the base portion 6 to secure a friction seal between the nozzle 14 and the neck of the liquid container. The liquid dispensing apparatus is then returned to its upright position and is ready for use. The liquid is accessible through spigot 26, its flow being controlled by valve 28.

When so mounted, the liquid container is secured to the liquid dispensing apparatus by inserting the nozzle firmly into the neck of the container and by reliance on the downward force exerted by the stabilizing arm. Since the base portion subtends an area greater than that subtended by the liquid container, and has a generally square bottom perimeter, said stable platform is provided for the combination, substantially reducing the risk that the combination can be upset by any inadvertent longitudinal force. Through the use of the plunger-type valve 28, air is bled into the liquid container whenever liquid is drawn, equalizing the pressure inside the container with that of the atmosphere, insuring a steady flow of liquid from the dispensing apparatus. Since the combination does not require substantially more area than that required by the liquid container alone, the combination can be used in locations where space is limited, such as a refrigerator shelf. Should small amounts of liquid leak from the container, they will be contained by the top surface 12 of the upper base portion 10 or by the large bore 13 located therein. To remove the liquid container from the dispensing apparatus, the process for inserting it is reversed.

While the embodiment of the liquid dispensing apparatus disclosed is for use in combination with a liquid container containing beverages, it can readily be seen that with little or no modification, the liquid dispensing apparatus can be used with soaps, detergents, photograhic chemicals and any other liquids that are sold and stored in relatively large containers but are used in relatively small amounts.

While I have shown and described embodiments of this invention in some detail, it will be understood that this description and illustrations are offered merely by way of example, and that the invention is to be limited only by the scope of the appended claims.

What is claimed as new and desired to be secured by a Letters Patent is:

1. A liquid dispensing appartus, for use in combination with an inverted liquid container, comprising: a base portion; a mounting bore centrally located in said base portion; a coupling means attached to and extending up from said base portion to form an integral unit with said base portion for insertion into the open neck of the liquid container to provide a press-fit secure seal with the liquid container; wherein said coupling means is a nozzle composed of a unitary piece of material that is slightly flexible while retaining its general shape, wherein the nozzle comprises: a conic shaped top portion extending above the surface of said base portion, a cylindrically shaped lower portion friction fitted in said mounting bore of said base portion, and a tapered center cavity extending from the apex of said nozzle top portion to an intermediate position in said nozzle lower portion; wherein said base portion includes an upper portion and a lower portion said base portion subtending an area greater than that subtended by the liquid container and said lower base portion having a square perimeter, said upper portion having a generally circular shape which is centered on said lower base portion wherein the upper base portion consists of a means for containing leaks from said coupling means, said means for containing leaks from said coupling means comprises a concave top surface of said upper portion concentric with said coupling means whereby a sink is formed surrounding said coupling means; a longitudinal bore extending from said tapered center cavity of said coupling means to the side of said base portion so that the liquid may be discharged from the container; a valved spigot in communication with said longitudinal bore at the side of said base portion to control the flow of liquid; and a stabilizing means extending from said base portion for contact with the bottom surface of the inverted liquid dispensing apparatus.

2. In the liquid dispensing aparatus of claim 1, wherein said spigot is provided with a plunger-type valve for equalizing the pressure within the liquid container with that of the atmosphere by allowing the passage of air into the liquid container through said longitudinal bore and opening in said coupling so that liquid will flow continually from the liquid dispensing apparatus.

3. A liquid dispensing appartus, for use in combination with an inverted liquid container, comprising: a base portion including a stable support; a coupling means extending up from said base portion for insertion into the open neck of the liquid container to provide a secure seal; an opening in said coupling means so that the liquid may be discharged from the container; a mounting bore in said base portion to accommodate said coupling means; a longitudinal bore extending from said opening of said coupling means to the side of said base portion; a valved spigot in communication with said longitudinal bore at the side of said base portion to control the flow of liquid; and a stabilizing means extending from said base portion; wherein said stabilizing means is an arm composed of a resilient material with a circular cross-section, comprising: a coupling section pivotably mounted to the side of said base portion so that said arm can be rotated relative to said base and the liquid container for insertion and removal of the liquid container from the combination, a vertical section extending up from said coupling section having a height substantially equal to that of the liquid container, and a horizontal section extending perpendicularly from said vertical section, wherein said horizontal section of said arm is in contact with and extends diametrically across the bottom of the inverted liquid container.

4. In the liquid dispensing appartus of claim 3 wherein said base portion is provided with a means for containing leaks from said coupling means within the liquid dispensing appartus.

5. In the liquid dispensing apparatus of claim 4 wherein said means for containing leaks from said coupling means comprises a large bore in the top surface of said base portion, said large bore being concentric with said coupling means; and said coupling means being located in said large bore.

* * * * *